US007128303B2

(12) United States Patent
Penlesky et al.

(10) Patent No.: US 7,128,303 B2
(45) Date of Patent: Oct. 31, 2006

(54) FAN MOUNTING SPACER ASSEMBLY

(75) Inventors: Robert G. Penlesky, Waukesha, WI (US); Danny W. Bothe, Watertown, WI (US)

(73) Assignee: Broan-Nu Tone LLC, Hartford, WI (US)

( * ) Notice: Subject to any disclaimer, the term of this patent is extended or adjusted under 35 U.S.C. 154(b) by 34 days.

(21) Appl. No.: 10/817,425

(22) Filed: Apr. 2, 2004

(65) Prior Publication Data

US 2005/0218289 A1 Oct. 6, 2005

(51) Int. Cl.
*F16M 7/00* (2006.01)
*F16D 1/00* (2006.01)

(52) U.S. Cl. ..... 248/674; 248/200; 248/300; 403/170; 52/503

(58) Field of Classification Search ..... 248/674, 248/300, 200, 511, 304; 403/170, 169; 446/121, 446/126; 52/503, 505
See application file for complete search history.

(56) References Cited

U.S. PATENT DOCUMENTS

| | | | |
|---|---|---|---|
| 1,030,028 | A | 6/1912 | Stampahar et al. |
| 1,395,833 | A | 11/1921 | Kling et al. |
| 1,532,635 | A | 4/1925 | Osbun |
| 1,895,642 | A | 1/1933 | Preble |
| 1,941,450 | A | 1/1934 | Sylvan |
| 1,970,054 | A | 8/1934 | Nordan |
| 2,019,867 | A | 11/1935 | Nelson |
| 2,108,283 | A | 2/1938 | Drew et al. |
| 2,189,008 | A | 2/1940 | Kurth |
| 2,220,127 | A | 11/1940 | Slayter |
| 2,278,581 | A | 4/1942 | Dexter |
| 2,325,657 | A | 7/1943 | Burkness |
| 2,483,377 | A | 9/1949 | Young |
| 2,562,600 | A | 7/1951 | Cadwell et al. |
| 2,580,103 | A | 12/1951 | Keller et al. |
| 2,668,491 | A | 2/1954 | Gerlitz |
| 2,673,514 | A | 3/1954 | Hanks |
| 2,710,573 | A | 6/1955 | Marker |
| 2,780,981 | A | 2/1957 | Miller |
| 2,875,678 | A | 3/1959 | Sheperd |
| 2,911,900 | A | 11/1959 | Rudy |
| 2,963,956 | A | 12/1960 | Hill |
| 2,987,258 | A | 6/1961 | North |

(Continued)

FOREIGN PATENT DOCUMENTS

| | | |
|---|---|---|
| BE | 648597 | 9/1964 |

(Continued)

OTHER PUBLICATIONS

Spartan Electric Company, Direct Drive Whole House Fans Publication, published prior to Nov. 2003.

(Continued)

*Primary Examiner*—Anita M. King
(74) *Attorney, Agent, or Firm*—Michael Best & Friedrich LLP

(57) ABSTRACT

Some embodiments of the present invention provide a spacer configured to mount a fan housing to a surface of a structural support. In some embodiments, the spacer includes a body, a first aperture passing through the body and having a first length through the body, and a second aperture passing through the body and having a second length through the body, wherein the second length is different than the first length. The body can be oriented in a first orientation with respect to the fan housing and structural support or in a second orientation with respect to the fan housing and structural support to mount the fan housing at different distances from a mounting surface of the structural support.

15 Claims, 6 Drawing Sheets

U.S. PATENT DOCUMENTS 3,002,676 A 10/1961 Papsdorf
3,045,579 A 7/1962 Jenn et al.
3,064,548 A 11/1962 Field
3,068,341 A 12/1962 Ortiz et al.
3,075,335 A 1/1963 Bandlow
3,101,662 A 8/1963 Alldritt
3,165,750 A * 1/1965 Philip ..... 29/600
3,211,080 A 10/1965 Rader
3,212,425 A 10/1965 Hazen
3,249,037 A 5/1966 Stalker
3,250,063 A 5/1966 Andrews
3,270,473 A 9/1966 Smith
3,276,597 A 10/1966 Mesek et al.
3,326,112 A 6/1967 Sadlow et al.
3,353,570 A * 11/1967 Sweat ..... 139/88
3,391,689 A 7/1968 Roger
3,438,180 A 4/1969 Klouda
3,521,418 A 7/1970 Bartoloni
3,547,274 A * 12/1970 Sosinkski ..... 211/89.01
3,577,710 A 5/1971 Feldman
3,606,593 A 9/1971 Steiner
3,630,007 A 12/1971 Neumann
3,636,306 A 1/1972 Bumpus
3,665,838 A 5/1972 Shepherd
3,676,571 A 7/1972 Rubinstein
3,692,977 A 9/1972 Duhamel et al.
3,698,833 A 10/1972 Cann et al.
3,732,030 A 5/1973 Mullings
3,743,439 A 7/1973 Cann
3,785,271 A 1/1974 Joy
3,788,207 A 1/1974 Doherty, II
3,861,894 A 1/1975 Marsh
3,871,723 A * 3/1975 Pray ..... 384/495
3,926,537 A 12/1975 Piper
3,952,638 A 4/1976 Felter et al.
4,073,597 A 2/1978 Barnhart et al.
4,115,082 A 9/1978 Newell
4,141,703 A 2/1979 Mulchi
4,149,028 A 4/1979 Gressitt et al.
4,177,305 A 12/1979 Feingold et al.
4,252,547 A 2/1981 Johnson
4,271,654 A * 6/1981 Jungbluth ..... 52/637
4,316,999 A 2/1982 Nattel
4,319,898 A 3/1982 Maierhofer
4,326,354 A * 4/1982 Hagberg ..... 446/126
4,335,271 A 6/1982 Haslbeck
4,335,647 A 6/1982 Timmons
4,336,749 A 6/1982 Barnhart et al.
4,382,440 A 5/1983 Kapp et al.
4,385,550 A 5/1983 Steiner et al.
4,385,911 A 5/1983 Popeil et al.
4,406,216 A 9/1983 Hott et al.
4,510,851 A 4/1985 Sarnosky et al.
4,594,940 A 6/1986 Wolbrink et al.
4,610,705 A 9/1986 Sarnosky et al.
4,628,802 A 12/1986 Steiner
4,630,182 A 12/1986 Moroi et al.
4,719,738 A * 1/1988 Lee ..... 52/607
4,780,018 A * 10/1988 Godden ..... 403/173
4,804,569 A 2/1989 Arisawa
4,867,640 A 9/1989 Penlesky et al.
4,889,572 A 12/1989 Danico et al.
5,372,447 A * 12/1994 Chung ..... 403/171
5,492,032 A * 2/1996 Hartman ..... 74/494
5,544,865 A * 8/1996 Abbaticchio ..... 256/67
5,590,500 A 1/1997 McCue
5,664,872 A 9/1997 Spearman et al.
5,816,005 A 10/1998 Han
5,878,985 A * 3/1999 Iannone ..... 248/205.1
5,879,232 A 3/1999 Luter, II et al.
5,916,102 A 6/1999 Peyton
5,918,972 A 7/1999 Van Belle
5,924,906 A * 7/1999 Grafton ..... 446/121
5,934,783 A 8/1999 Yoshikawa
5,947,652 A * 9/1999 Wagner ..... 408/1 R
6,027,406 A 2/2000 Yazici
6,095,671 A 8/2000 Hutain
6,261,175 B1 7/2001 Larson et al.
6,273,633 B1 * 8/2001 Husson et al. ..... 403/218
6,295,945 B1 * 10/2001 Amanze ..... 116/173
6,330,774 B1 12/2001 Weinstein
6,340,237 B1 1/2002 Koga et al.
6,367,218 B1 9/2002 Lombardo
6,446,404 B1 9/2002 Bassin
6,488,579 B1 12/2002 Larson et al.
6,498,423 B1 12/2002 Bell et al.
6,672,789 B1 * 1/2004 Chen ..... 403/171
2005/0036829 A1 * 2/2005 Trull ..... 403/170

FOREIGN PATENT DOCUMENTS

CA 1332592 10/1994
FR 1234767 10/1960
JP 11117497 4/1999

OTHER PUBLICATIONS

Emerson Environmental Products, Whole House Fan and Shutter System Owners Manual, Dec. 1982.

* cited by examiner

| | APA Association | Boise Cascade | Georgia Pacific | Louisiana Pacific | Nascor Corp. | Trus Joist Corp. |
|---|---|---|---|---|---|---|
| X | 0.375 | 0.375 | 0.375 | 0.375 | 0.375 | 0.375 |
| | | | | | | 0.437 |
| Y | 1.5 | 1.5 | | | 1.5 | 1.5 |
| | 1.75 | 1.75 | 1.75 | 1.75 | | 1.75 |
| | | 2 | | | | |
| | 2.312 | 2.312 | 2.312 | 2.312 | | 2.312 |
| | 2.5 | 2.5 | 2.5 | 2.5 | 2.5 | |
| | | 2.562 | | | | |
| | 3.5 | 3.5 | 3.5 | | | 3.5 |
| Z | | 1.312 | | | | |
| | | 1.5 | | 1.5 | 1.5 | 1.5 |
| | | | | | 2.5 | |

FAN MOUNTING SPACER ASSEMBLY

BACKGROUND OF THE INVENTION

Ventilation fans, such as those often found in bathrooms, typically draw air from within an area and pass the exhausted air out to another location, such as through a vent in the gable or roof of a home or other building structure. Some ventilation fans are used to circulate air within an area. Ventilation fans typically include a rotating fan wheel coupled to and driven by a motor or other driving unit supported within the fan housing. When rotated, the fan wheel generates airflow into a housing of the fan and out of an outlet opening.

Conventional ventilation fans are often mounted to a building structure, such as in a ceiling or wall of the building structure. In many cases, such fans are mounted to a beam, joist, stud, or other portion of the building structure. For example, the housing of a ventilation fan can be secured to a structural support by one or more fasteners passed through apertures in the housing and into the structural support.

SUMMARY OF THE INVENTION

Some embodiments of the present invention provide a spacer configured to mount a fan housing to a surface of a structural support, wherein the spacer comprises a body; a first aperture passing through the body, the first aperture having a first length through the body; and a second aperture passing through the body, the second aperture having a second length through the body, the second length different than the first length; wherein the body has a first orientation with respect to the fan housing and structural support in which the body separates the fan housing from the surface of the structural support by the first length when installed with a fastener passed through the first aperture and into the structural support; and wherein the body has a second orientation with respect to the fan housing and structural support in which the body separates the fan housing from the surface of the structural support by the second length when installed with a fastener passed through the second aperture and into the structural support.

In some embodiments, a spacer configured to mount a fan housing to a web portion of a structural support is provided, and comprises: a body defining a first aperture and a second aperture extending in different directions through the body, the body positionable in a first orientation between the web portion and the housing to mount the fan housing on the structural support, and positionable in a second orientation between the web portion and the fan housing to mount the fan housing on the structural support, the body including a first mounting surface engageable with the fan housing when the body is in the first orientation, the first aperture extending through the first mounting surface and dimensioned to receive a fastener to connect the fan housing in spaced relationship to the web when the body is in the first orientation; and a second mounting surface engageable with the fan housing when the body is in the second orientation, the second aperture extending through the second mounting surface and dimensioned to receive a fastener to connect the fan housing in spaced relationship to the web when the body is in the second orientation; wherein the fan housing is spaced a first distance from the web in the first orientation of the body, and a second distance from the web in the second orientation of the body, the second distance different than the first distance.

Some embodiments of the present invention provide a spacer for mounting a fan housing in positions spaced from a mounting surface of a structural support, wherein the spacer comprises a body having a first dimension in a first orientation and a second dimension in a second orientation different than the first orientation; a first aperture defined in the body and shaped to receive a fastener through the body; a second aperture defined in the body and shaped to receive a fastener through the body; the spacer having a first mounting orientation with respect to the fan housing and structural support in which the spacer separates the fan housing from the mounting surface of the structural support by a distance substantially the same as the first dimension; and a second mounting orientation with respect to the fan housing and structural support in which the spacer separates the fan housing from the mounting surface of the structural support by a second distance substantially the same as the second dimension, wherein the second distance is different than the first distance.

In some embodiments of the present invention, a method of mounting a fan housing in spaced relationship to a mounting surface of a structural support is provided, and comprises: determining a desired space between the mounting surface and the fan housing; selecting one of a first mounting orientation of a spacer with respect to the mounting surface and the fan housing and a second mounting orientation of the spacer with respect to the mounting surface and the fan housing based at least in part upon the desired space, the spacer having a first aperture through which a fastener is passed to mount the spacer to the mounting surface in the first mounting orientation, and a second aperture through which a fastener is passed to mount the spacer to the mounting surface in the second mounting orientation, the spacer separating the fan housing from the mounting surface a first distance in the first orientation and a different second distance in the second orientation; orienting the spacer in the selected mounting orientation; inserting a fastener through one of the first and second apertures corresponding to the selected mounting orientation; and inserting the fastener into the mounting surface to secure the housing in spaced relationship with respect to the mounting surface.

Some embodiments of the present invention provide a fan and spacer assembly adapted for mounting to a structural support, wherein the fan and spacer assembly comprises a fan assembly comprising a housing; a fan located within the housing and rotatable to generate airflow into the housing and out of an exhaust outlet of the housing; and a spacer comprising a body; a first aperture passing through the body, the first aperture having a first length through the body; and a second aperture passing through the body, the second aperture having a second length through the body, the second length different than the first length; wherein the body has a first orientation with respect to the fan housing and structural support in which the body separates the fan housing from the surface of the structural support by the first length when installed with a fastener passed through the first aperture and into the structural support; and wherein the body has a second orientation with respect to the fan housing and structural support in which the body separates the fan housing from the surface of the structural support by the second length when installed with a fastener passed through the second aperture and into the structural support.

Further aspects of the present invention, together with the organization and operation thereof, will become apparent from the following detailed description of the invention when taken in conjunction with the accompanying drawings, wherein like elements have like numerals throughout the drawings.

Figure 1:
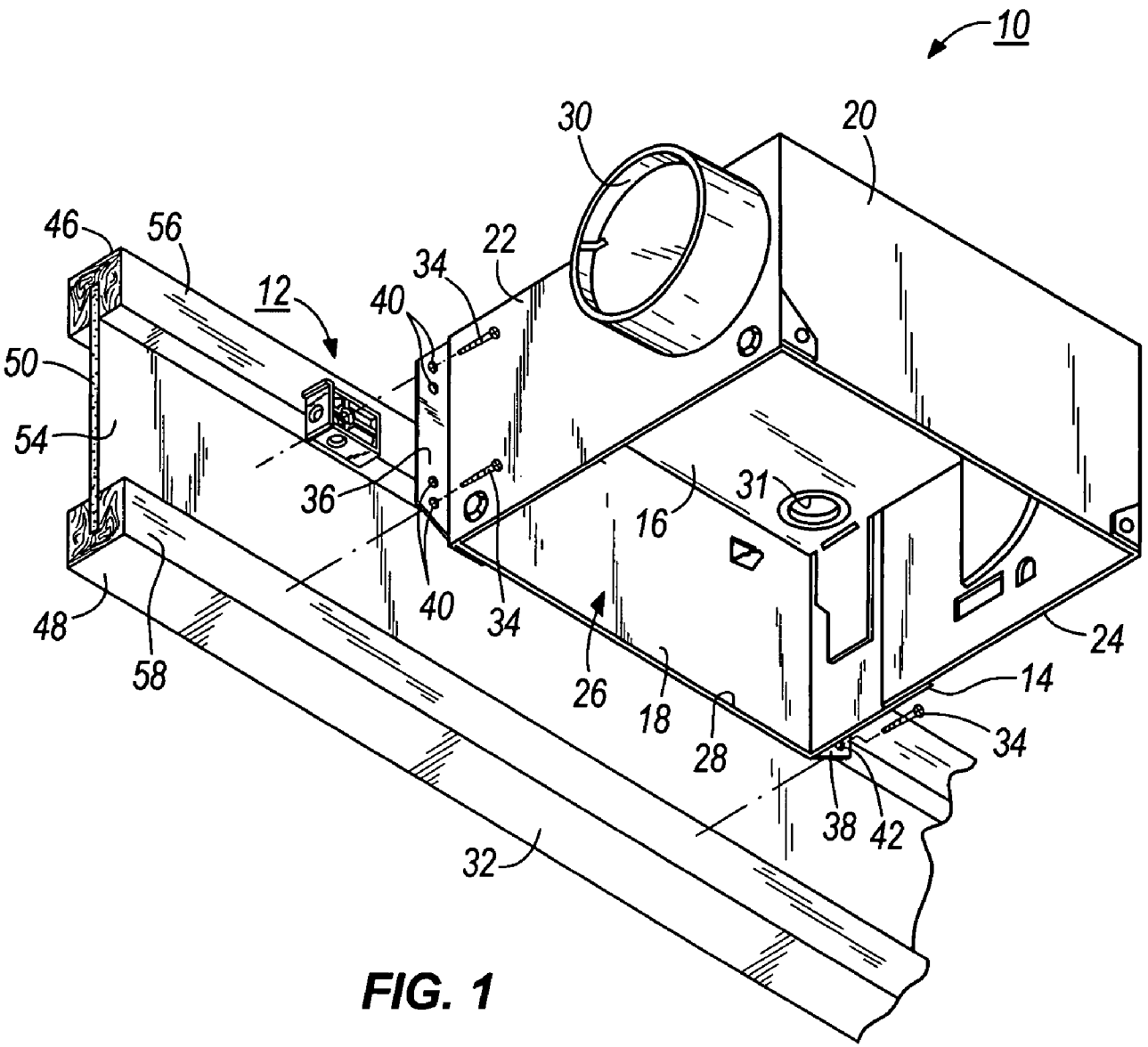
FIG. 1 is a perspective view of a fan housing, a structural support, and a spacer for mounting the fan housing to the structural support according to an embodiment of the present invention.
Figure 2A:
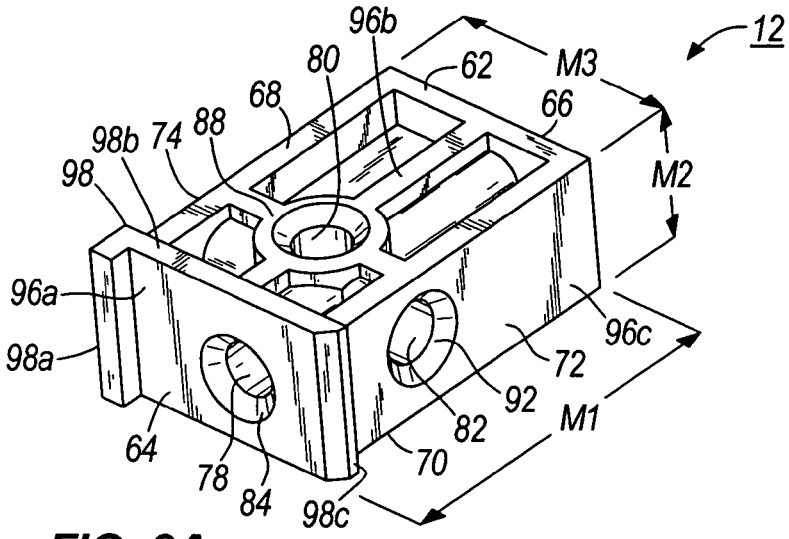
FIG. 2A is a perspective view of the spacer shown in FIG. 1.
Figure 2C:
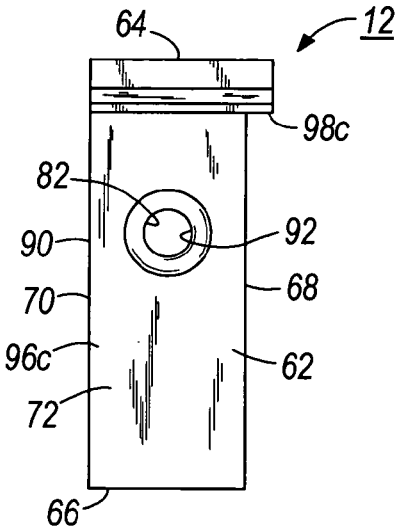
FIG. 2C is an elevational side view of the spacer shown in FIG. 1.
Figure 2B:
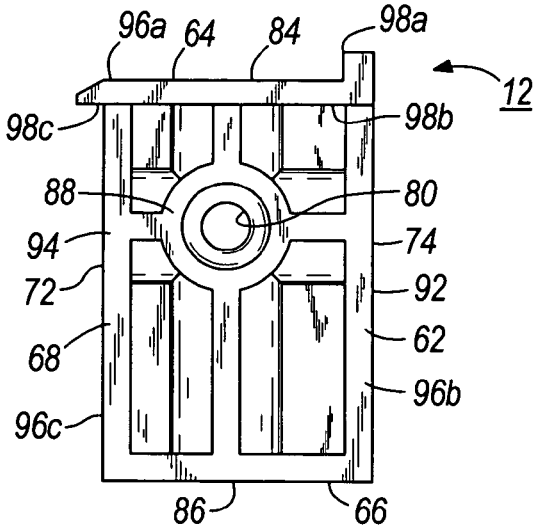
FIG. 2B is a top view of the spacer shown in FIG. 1.
Figure 2D:
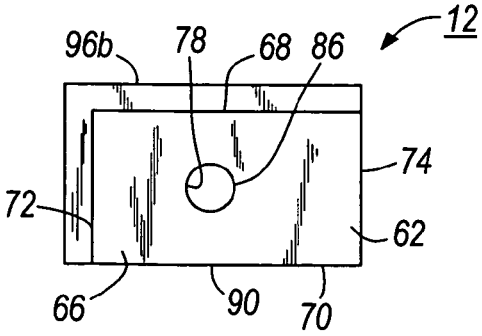
FIG. 2D is an end view of the spacer shown in FIG. 1.

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. The ventilation fan and spacer referred to in the present invention can be installed and operated in any orientation desired. In addition, terms such as "first", "second", and "third" are used herein and in the appended claims for purposes of description and are not intended to indicate or imply relative importance or significance.

DETAILED DESCRIPTION

FIG. 1 illustrates a portion of a ventilating exhaust fan 10 and a spacer 12 according to an embodiment of the present invention. The ventilating exhaust fan 10 can ventilate any room or area, such as a bathroom or other structure. The fan 10 can draw air through one or more apertures or vents and to discharge the air through an outlet.

The fan 10 can have a housing 14 having any shape desired, such as a round shape, a rectangular, triangular, or other polygonal shape, an irregular shape, and the like. By way of example only, the housing 14 of the illustrated embodiment has a generally rectangular shape, and has a base wall 16, sidewalls 18, 20, a front wall 22, and a back wall 24. Together, the base wall 16, front wall 18, sidewalls 20, 22, and back wall 24 at least partially define an interior space 26 of the fan 10. The back wall 16, front wall 18, and sidewalls 20, 22 can define an opening 28 of the housing 14 between the interior space 26 and an exterior of the housing 14.

In some embodiments, the housing 14 has an outlet opening or outlet fitting 30 through which airflow exits the housing 14. In the illustrated embodiment of FIG. 1, the outlet opening 30 extends through the front wall 22 of the housing 14 and communicates with the interior space 26. In other embodiments (not shown), the outlet opening 30 can be in any location on the housing 14 and can extend through one or more of the base wall 16, the side walls 20, 22, or the back wall 24. The outlet opening 30 of the fan 10 can have any shape (round, oval, rectangular, irregular, and the like) for connection to a similarly sized duct or duct system that directs the airflow to another location. In other embodiments (e.g., for air heating fans, air circulation fans, and the like), air is instead exhausted back into the same room or area from which it was drawn.

The housing 14 can include one or more openings 31 through which field wiring can extend to supply power to elements of the fan 10, such as, a fan motor, a light, a heating element, and the like. The housing 14 can also support a ventilating exhaust fan having a fan scroll and a fan wheel (e.g., a paddle wheel fan, a squirrel cage fan, an impeller, or any other rotating fan element or assembly desired), such as the ventilating exhaust fan assembly described in U.S. Pat. No. 6,261,175, issued Jul. 17, 2001, which is hereby incorporated by reference insofar as it relates to fan housings, fans, and other components of fan assemblies.

The housing 14 can also be mounted in any orientation, such as in a vertical orientation installed in a wall, a horizontal orientation installed in a ceiling, or in any other orientation desired. The housing 14 can be secured within a wall, ceiling, or other building structure in a partially or fully recessed position. In such cases, the housing 14 can be received within an aperture or recessed portion of the wall, ceiling, or other building structure. Alternatively, the housing 14 can be secured to a building structure in a non-recessed position. In order to secure the housing 14 with respect to a wall, ceiling, or other building structure as described above, the housing 14 can be secured to any suitable structural support of the building structure. As used herein and in the appended claims, the term "structural support" includes any building structural element to which the fan 10 can be mounted, and includes without limitation joists, sub-joists, studs, I-beams or beams having other shapes, struts, rafters, headers, girders, trusses, and the like.

The housing 14 of the illustrated embodiment of FIG. 1 is oriented substantially vertically, with the base wall 16 substantially perpendicular to a structural support 32. In alternate embodiments, the housing 14 can have other orientations with respect to the building structure and its structural support(s) 32, typically determined at least in part by space constraints, the orientation of the structural support(s) 32, the spacing between structural supports 32, and/or whether the housing 14 is mounted in a wall or in a ceiling.

One or more fasteners 34 can be used to secure the housing 14 (and therefore, the exhaust fan 10) to a building structure. Fasteners 34 can connect any part of the housing 14, such as the base wall 16, either sidewall 18, 20, the front wall 22, back wall 24, or mounting flanges 36, 38, to the building structure, and can extend through attachment holes 40, 42 in the housing 14 for this purpose. In the illustrated embodiment of FIG. 1, fasteners 34 pass through attachment holes 40, 42 in mounting flanges 36, 38 adjacent to the side wall 18 of the housing 14, thereby securing the side wall 18 of the housing 14 to a structural support 32. It will be appreciated that if mounting flanges 36, 38 are used to mount the housing 14 as just described, such flanges 36, 38 can be located on or adjacent any wall of the housing 14. Any conventional fastener can be used to secure the housing 14 as just described, such as screws, nails, rivets, pins, posts, clips, clamps, inter-engaging elements, and any combination of such fasteners.

In some embodiments, the housing 14 is secured to the structural support 32 in two or more locations in order to provide a more secure attachment to the structural support 32 and/or to distribute the weight of the fan assembly 10 along the structural support 32. For example, in the illustrated embodiment of FIG. 1, the housing 14 is secured to the structural support 32 with four fasteners 34 and two spacers 12 (only one is shown in FIG. 1). Two fasteners 34 extend through attachment holes 40, 42 in mounting flanges 36, 38 and into upper surfaces 56, 58 of respective flanges 46, 48 and two fasteners 34 extend through attachment holes 40, 42 in mounting flanges 36, 38, through spacers 12, and into the web portion 50 of the structural support 32 to secure the four corners of the housing 14 on the structural support 32. While reference is made herein to embodiments in which two spacers 12 are used to secure a housing 14 to a structural support, it should be understood that in some embodiments, a single spacer 12 or three or more spacers 12 can be used to secure the housing 14 to a structural support 32.

In the illustrated embodiment of FIG. 1, the fan housing 14 is mounted on an engineered wood beam 32 having a generally I-shaped cross section. However, it should be understood that the fan housing 14 can be mounted to other types of structural supports 32 (e.g., having other shapes and dimension). By way of example only, the housing 14 can instead be mounted on structural supports 32 having other shapes, such as a rectangular cross sectional shape, a rotund or round cross-sectional shape, any other polygonal cross sectional shape, an irregular cross sectional shape, an L or C-shaped cross sectional shape, and the like.

With reference to the illustrated embodiment of FIGS. 3A–5B, three different structural supports 32*a*, 32*b*, 32*c* having different dimensions and configurations are shown by way of example only. Features and elements of the first, second, and third structural supports 32*a*, 32*b*, 32*c* are identified herein and in FIGS. 3A–5B with a reference number and the letters "a", "b", and "c", respectively. Each of the illustrated structural supports 32*a*, 32*b*, 32*c* includes flanges 46, 48 and a web 50 extending therebetween.

Figure 3A:
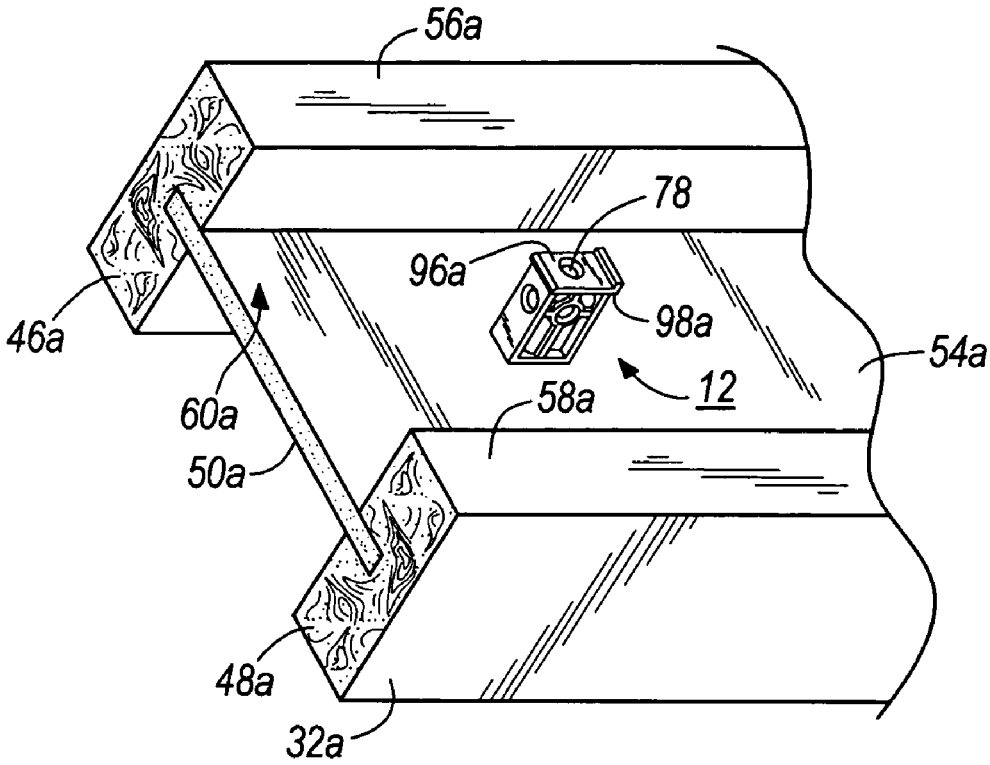
FIG. 3A is a perspective view of the spacer shown in FIG. 1, placed in a first orientation relative to a structural support.
Figure 3B:
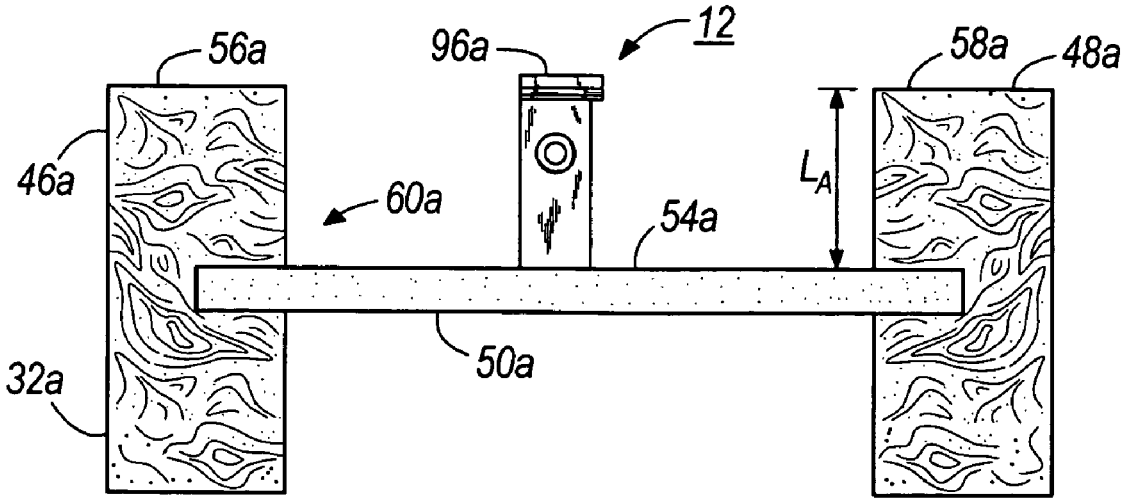
FIG. 3B is a side view of the spacer shown in FIG. 1, placed in the first orientation relative to a structural support.
Figure 4A:
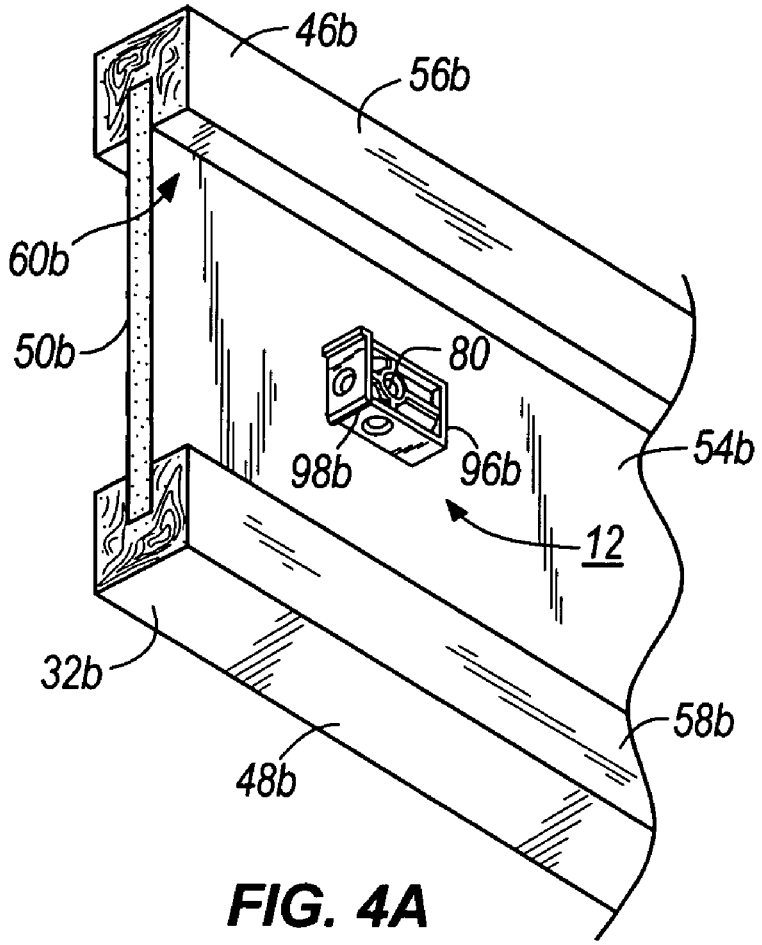
FIG. 4A is a perspective view of the spacer shown in FIG. 1, placed in a second orientation relative to another structural support.
Figure 4B:
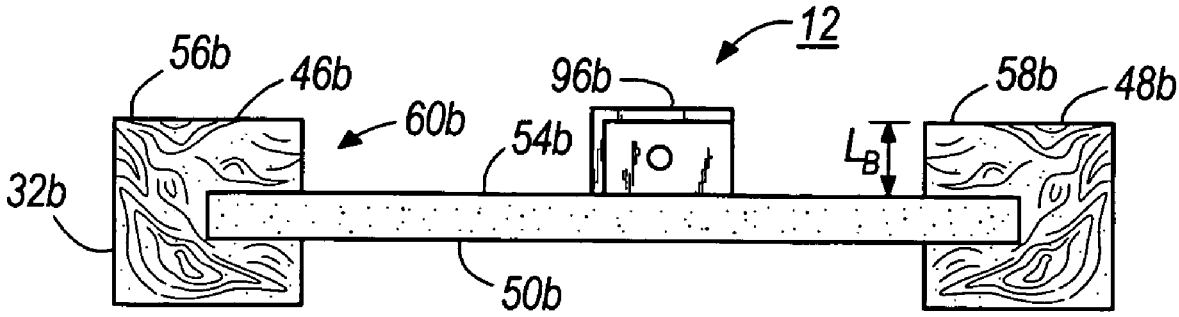
FIG. 4B is a side view of the spacer shown in FIG. 1, placed in the second orientation relative to the structural support illustrated in FIG. 4A.
Figure 5A:
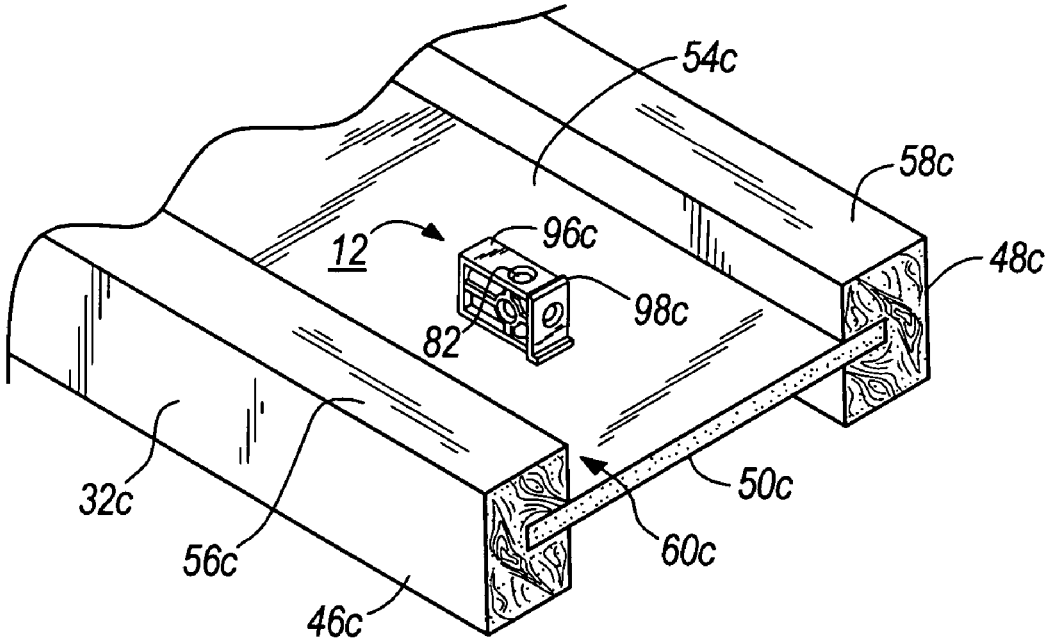
FIG. 5A is a perspective view of the spacer shown in FIG. 1, placed in a third orientation relative to another structural support.
Figure 5B:
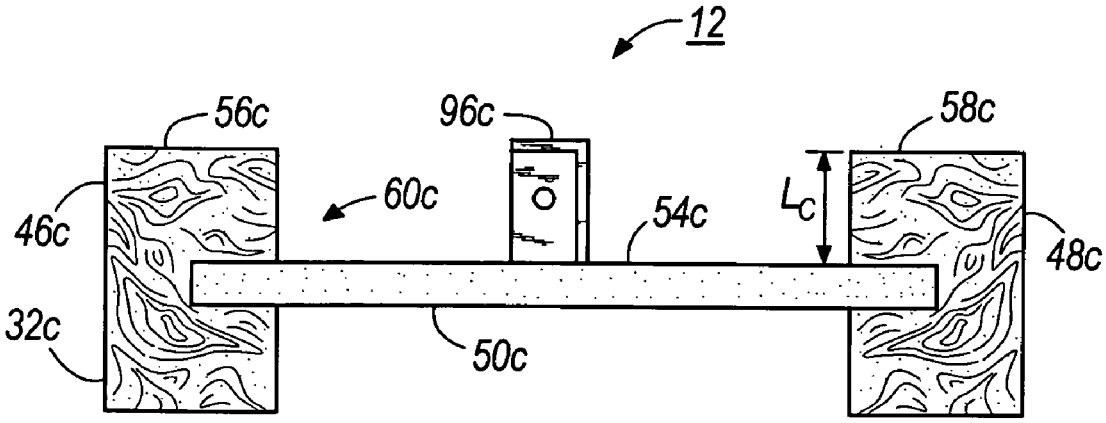
FIG. 5B is a side view of the spacer shown in FIG. 1, placed in the third orientation relative to the structural support illustrated in FIG. 5A.

Each of the illustrated structural supports 32*a*, 32*b*, 32*c* also include recessed portions 60 defined between upper surfaces 54 of the respective webs 50 and upper surfaces 56, 58 of the respective flanges 46, 48 (with reference to the orientation of the structural supports 32*a*, 32*b*, 32*c* shown in FIGS. 3B, 4B, and 5B). In the illustrated embodiments of FIGS. 3A–5B, each of the structural supports 32*a*, 32*b*, 32*c* have differently sized recessed portions 60. For example, FIGS. 3A and 3B illustrate a structural support 32*a* having a first recessed distance $L_A$ defined between the upper surface 54*a* of the web 50*a* and a plane in which the upper surfaces 56*a*, 56*a* of the flanges 46*a*, 48*a* lie. Similarly, FIGS. 4A and 4B illustrate a structural support 32*b* having a second recessed distance $L_B$ defined between the upper surface 54*b* of the web 50*b* and a plane in which the upper surfaces 56*b*, 56*b* of the flanges 46*b*, 48*b* lie. Also, FIGS. 5A and 5B illustrate a structural support 32*c* having a third recessed distance $L_C$ defined between the upper surface 54*a* of the web 50*c* and a plane in which the upper surfaces 56*c*, 56*c* of the flanges 46*c*, 48*c* lie.

As mentioned above, in some embodiments, the housing 14 can be secured to a structural support at two or more locations. In some of these embodiments, one or more of the fasteners 34 can connect the housing 14 to a first portion of the structural support 32 and one or more fasteners 34 can connect the housing 14 to another portion of the structural support 32 in a different plane than the first portion of the structural support 32. By way of example only, one fastener 34 connects the housing 14 of FIG. 1 to the web 50 of the structural support 32, while two fasteners 34 connect the housing 14 to a surface 58 of the structural support 32 located in a different plane than the web 50. To facilitate such mounting of the housing 14 while still orienting the base wall 16 in a direction that is substantially perpendicular to the structural support 32 (and/or orienting the sidewalls 18, 20 in a direction substantially parallel to the web 50), the spacer 12 is inserted between the housing 14 and the recessed portion 60 of the structural support 32.

As shown in FIGS. 3A–5B, the spacer 12 of the present invention can be configured to accommodate mounting of a fan housing 14 on a number of different structural supports (e.g., the structural supports 32*a*, 32*b*, 32*c* of FIGS. 3A–5B) having different dimensions (e.g., having different recessed distances L). As will be described in greater detail below, the same spacer 12 can therefore be used to mount the housing 14 of the ventilation fan 10 at different distances from a mounting surface, such as the surface of a web 50 as shown in FIGS. 3A–5B or a mounting surface of any other structural support 32.

As shown in FIGS. 2A–2D, the spacer 12 includes a body 62 molded (e.g., injection molded) from a plastic material. The body 62 can be manufactured in any other manner, such as by casting, stamping, machining, bending, pressing, extruding, or other manufacturing operations. Also, the body 62 can be manufactured from other materials, including metal, wood, rubber, and other synthetic materials, ceramics, fiberglass, and the like. The body 62 can have any shape desired, such as a rectangular, triangular or other polygonal shape, a rounded or rotund shape, an irregular shape, and the like. By way of example only, the body 62 of the illustrated embodiment has a generally rectangular shape, and has a front side 64, a back side 66, a top side 68, a bottom side 70, a right side 72, and a left side 74.

In some embodiments, such as the illustrated embodiment of FIGS. 2A–2D, the body 62 defines first, second, and third apertures 78, 80, 82. The first aperture 78 in the illustrated embodiment extends through the body 62 between a first end 84 located on the front side 64 and a second end 86 located on the back side 66 of the body 62. The second aperture 80 of this embodiment extends through the body 62 between a first end 88 located on the top side 68 and a second end 90 located on the bottom side 70 of the body 62. The third aperture 82 of this embodiment extends through the body 62 between a first end 92 located on the right side 72 and a second end 94 located on the left side 74 of the body 62. In other embodiments (not shown), the body 62 can define two, four, or more apertures, extending through the body 62, such as two, four, or more apertures extending through the body 62 between opposite sides of the body 62.

As shown in FIGS. 2A–2D, in some embodiments, one or more of the ends 84, 88, 92 of the first, second, and third apertures 78, 80, 82 are tapered to guide fasteners 34 into the first, second, and third apertures 78, 80, 82, respectively. In addition, in some embodiments, such tapered ends 84, 88, 92 of the first, second, and third apertures 78, 80, 82 operate to orient the spacer 12 with respect to either or both the housing 14 and the structural support 32.

In some embodiments, the first, second, and third apertures 78, 80, 82 intersect at an intersection point (not shown). In addition, imaginary lines extending through the first, second, and third apertures 78, 80, 82 are substantially perpendicular to one another. In other embodiments, less than all of the apertures 78, 80, 82 intersect. For example, in some embodiments, each of the apertures 78, 80, 82 extend through the body 62 without intersecting the other apertures. Also, the first, second, and third apertures 78, 80, 82 can have different relative orientations and arrangements (i.e., the imaginary lines extending through the first, second, and third apertures 78, 80, 82 need not necessarily be perpendicular to one another, but can extend at other angles with respect to one another).

With continued reference to the embodiment shown in FIGS. 2A–2D, the first aperture 78 can have a first length $M_1$ defined between the first and second ends 84, 86, the second aperture 80 can have a second length $M_2$ defined between the first and second ends 88, 90, and the third aperture 82 can have a third length $M_3$ defined between the first and second ends 92, 94. In this embodiment, each of the first, second, and third distances $M_1$, $M_2$, $M_3$ is different. However, in other embodiments, two or all three of the first, second, and third distances $M_1$, $M_2$, $M_3$ can be the same.

Figures 6, 7:
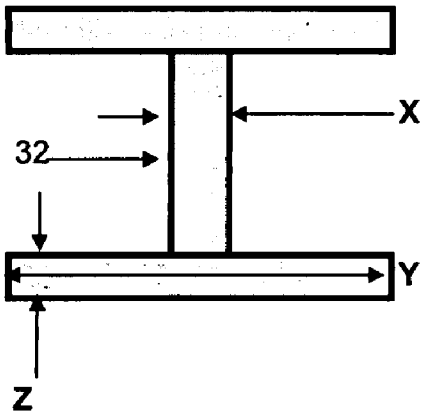
FIG. 6 is an elevational side view of a structural support for use with the spacer and housing shown in FIG. 1.
FIG. 7 is a table showing the standard dimensions of a number of conventional structural supports, such as the structural supports shown in FIGS. 1, 3A–5B, and 6.

In some embodiments, the first, second, and third distances $M_1$, $M_2$, $M_3$ are selected to correspond to the recessed distances (e.g., the recessed distances $L_A$, $L_B$, $L_C$) of one or more conventional structural supports 32 (e.g., the first, second, and third structural supports 32*a*, 32*b*, 32*c* of FIGS. 3A–5B). FIGS. 6 and 7 provide standard dimensions of a number of commonly used structural supports 32. As shown in FIGS. 6 and 7, reference letter "X" refers to the thickness of the web 50, reference letter "Y" refers to the thickness of the flanges 46, 48, and reference letter "Z" refers to the width of the flanges 46, 48. In some embodiments, the spacer 12 can be configured so that the first, second, and third distances $M_1$, $M_2$, $M_3$ of the first, second, and third apertures 78, 80, 82 correspond to the recessed distances L of one or more of the commonly used structural supports of FIGS. 6 and 7. As described above, some spacers 12 according to the present invention have two or more distances $M_1$, $M_2$, $M_3$ that are the same, in which case such distances can correspond to one or two recessed distances L of the commonly used structural supports of FIGS. 6 and 7.

In the illustrated embodiment, the first, second, and third distances $M_1$, $M_2$, $M_3$ of the first, second, and third apertures 78, 80, 82 are selected to establish the desired distance between the housing 14 and the upper surfaces 54 of the respective webs 50. In other embodiments, the first, second, and third distances $M_1$, $M_2$, $M_3$ can be defined by the body 62. For example, in some embodiments, the first distance $M_1$ can be defined between the front and back sides 64, 66, the second distance $M_2$ can be defined between the top and bottom sides 68, 70, and the third distance $M_3$ can be defined between the right and left sides 72, 74.

The body 62 can have any dimension $M_1$, $M_2$, $M_3$ desired, any or all of which can be selected to correspond to recessed distances L of structural supports 32 in order to mount a fan housing 14 to such structural supports 32 as described above. In some embodiments, a first aperture 78 having a length $M_1$ of between about 1.4 inches and about 1.7 inches, a second aperture 80 having a length $M_2$ of between about 0.4 inches and about 0.7 inches, and a third aperture 82 having a length $M_3$ of between about 0.8 inches and about 1.1 inches, provides good mounting results for mounting to a number of different structural supports 32. In other embodiments, a first aperture 78 having a length $M_1$ of between about 1.45 inches and about 1.65 inches, a second aperture 80 having a length $M_2$ of between about 0.45 inches and about 0.65 inches, and a third aperture 82 having a length $M_3$ of between about 0.85 inches and about 1.05 inches, provides better mounting results for mounting to a number of different structural supports 32. In still other embodiments, a first aperture 78 having a length $M_1$ of between about 1.5 inches and about 1.6 inches, a second aperture 80 having a length $M_2$ of between about 0.5 inches and about 0.6 inches, and a third aperture 82 having a length $M_3$ of between about 0.9 inches and about 1.0 inches, provides even better mounting results for mounting to a number of different structural supports 32. The spacer 12 illustrated in FIGS. 2A–2D has a first aperture 78 with a length $M_1$ of about 1.56, a second aperture 80 with a length $M_2$ of about 0.56 inches, and a third aperture 82 having a length $M_3$ of about 0.97 inches, and provides still better mounting performance results for mounting to a number of different structural supports 32. As explained below, the length of the first, second, and third apertures 78, 80, 82 can be selected to correspond to the dimensions of a number conventional structural supports 32, including others not described herein.

The spacer 12 also includes a number of mounting surfaces 96. In the illustrated construction of FIGS. 2A–2D, the spacer 12 includes three mounting surfaces 96*a*, 96*b*, 96*c*, provided on the front side 64, top side 68, and right side 72 of the body 62, respectively. However, any number of different mounting surface 96 can be used in other embodiments, depending at least in part upon the shape of the body 62 and the position and orientation of the apertures therethrough. As explained in greater detail below, one of the mounting surfaces 96*a*, 96*b*, 96*c* is positioned adjacent to and facing the housing 14 during installation of a housing 14 and a spacer 12.

In some embodiments of the present invention, the body 62 includes one or more outwardly extending protrusions 98 (such as lips, ledges, flanges, pins, ribs, and the like). The protrusions 98 can be located anywhere on or adjacent the mounting surfaces 96, and in some embodiments are located at edges of one or more mounting surfaces 96 as shown in FIGS. 2A–2D. In the illustrated embodiment of FIGS. 2A–2D, a lip 98 having three segments 98*a*, 98*b*, 98*c* extends outwardly from respective mounting surfaces 96*a*, 96*b*, 96*c*. As described below, the lip 98 can operate to locate the spacer 12 with respect to a feature of the housing 14 (e.g., a corner, edge, flange, or other portion of the housing 14) during mounting of the housing 14 and the spacer 12 on the structural support 32. The lip 98 can also prevent an installer from orienting the spacer 12 incorrectly or in an undesirable orientation (e.g., in an orientation in which one of the mounting surfaces 96*a*, 96*b*, 96*c* is adjacent to and faces the web 50 of a structural support 32).

The spacer 12 of the illustrated embodiment of FIGS. 1–5B can be oriented in any one of first, second, and third orientations to facilitate flush mounting of the housing 14 on a number of differently configured structural supports 32 (i.e., having a number of different recessed distances L). In other words, the spacer 12 illustrated in FIGS. 1–5B can be oriented in different manners with respect to differently configured structural supports 32 so that the fan housing 14 is properly oriented with respect to each such structural support 32 as described above. For example, as shown in FIGS. 3A and 3B, the spacer 12 can be oriented in a first orientation in which an imaginary line extending through the first aperture 78 is substantially perpendicular to the structural support 32 and in which the first mounting surface 96*a* is oriented to engage one of the walls (i.e., the side wall 18) or one of the mounting flanges 36, 38 of the housing 14.

Alternatively, and as shown in FIGS. 4A and 4B, the spacer 12 of the illustrated embodiment of FIGS. 1–5B can be re-oriented in a second orientation in which an imaginary line extending through the second aperture 80 is substantially perpendicular to the structural support 32 and in which the second mounting surface 96*b* is oriented to engage one of the walls (i.e., the side wall 18) or one of the mounting flanges 36, 38 of the housing 14. As shown in FIGS. 5A and 5B, this spacer 12 can be re-oriented in a third orientation in which an imaginary line extending through the third aperture 82 is substantially perpendicular to the structural support 32 and in which the third mounting surface 96*c* is oriented to engage one of the walls (i.e., the side wall 18) or one of the mounting flanges 36, 38 of the housing 14.

To mount the housing 14 in a building structure using a spacer 12 according to the present invention, an installer first selects a desired mounting location for the housing 14. If the desired mounting location necessitates or suggests the desirability of mounting the housing 14 on a structural support 32 having a recessed portion 60 or otherwise mounting the housing 14 in spaced relationship with the selected mounting surface, the installer then orients the spacer 12 in an orientation corresponding to the recessed distance L of the structural support 32 (or the desired space between the mounting surface of the structural support 32 and the housing 14). For example, in embodiments such as the embodiment of FIGS. 3A and 3B in which it is necessary or desirable to mount the housing 14 on a structural support 32*a* having a recessed distance $L_A$, the installer orients the spacer 12 in the first orientation so that the first mounting surface 96*a* is positioned to engage the housing 14 and so that the first aperture 78 extends from the housing 14 to the web 50 of the structural support 32*a*.

Similarly, in embodiments such as the embodiment of FIGS. 4A and 4B in which it is necessary or desirable to mount the housing 14 on a structural support 32*b* having a recessed distance $L_B$, the installer orients the spacer 12 in the second orientation so that the second mounting surface 96*b* is oriented to engage the housing 14 and so that the second aperture 80 extends from the housing 14 to the web 50 of the structural support 32*b*. This orientation of the spacer 12 can be used where it is necessary or desirable to mount the housing 14 a desired distance $L_B$ from any mounting surface of any other type of structural support 32. In embodiments such as the embodiment of FIGS. 5A and 5B in which it is necessary or desirable to mount the housing 14 on a structural support 32*c* having a recessed distance $L_C$, the installer orients the spacer 12 in the third orientation so that the third mounting surface 96*c* is oriented to engage the housing 14 and so that the third aperture 82 extends from the housing 14 to the web 50 of the structural support 32*c*. This orientation of the spacer 12 can be used where it is necessary or desirable to mount the housing 14 a desired distance $L_C$ from any mounting surface of any other type of structural support 32.

After the installer selects an appropriate orientation for the spacer 12, the installer arranges the spacer 12 on the web portion 50 of the structural support 32, and in some embodiments aligns the spacer 12 and the housing 14 with an appropriate lip 98 (where used) of the spacer 12. For example, in the illustrated embodiment of FIG. 1, the installer aligns the mounting flange 36 with the second lip section 98*b*. The installer can then drive a fastener 32 through the housing 14 (i.e., one of the walls 16–24 or the mounting flanges 40, 42), the spacer 12 (i.e., through one of the first, second, and third apertures 78, 80, 82), and into the web portion 50 of the structural support 32.

As mentioned above, in some embodiments of the present invention, the lip 98 limits the number of orientations of the spacer 12. For example, in the illustrated embodiment of FIGS. 3A–3B, the lip 98 prevents the spacer 12 from being oriented in a fourth orientation in which the first mounting surface 96*a* is adjacent to and faces the web 50, a fifth orientation in which the second mounting surface 96*b* is adjacent to and faces the web 50, and a sixth orientation in which the third mounting surface 96*c* is adjacent to and faces the web 50.

While reference is made herein to embodiments in which a single spacer 12 is used to mount a housing 14 on a structural support 32, it should be understood that in other embodiments two or more spacers 12 can also or alternatively be used to mount the same housing 14 to a structural support 32 or to different structural supports 32. For example, two or more spacers 12 can be spaced apart along a common web 50 of a structural support 32 (i.e., between the web 50 and each of the mounting flanges 36, 38), can be stacked on the web 50 (i.e., between one of the mounting flanges 36, 38 and the web 50) in any combination of orientations to provide additional orientations and possible distances between the housing 14 and the web 50, and the like.

Various alternatives and embodiments are contemplated as being within the scope of the following claims particularly pointing out and distinctly claiming the subject matter regarded as the invention. For example, while reference is made herein to a fan housing 14 and to a method of mounting a fan housing 14 on a structural support 32, it should be understood that the spacer 12 of the present invention can also or alternately be used to mount other housings and devices, such as, for example, light assemblies, electrical boxes, phone and cable boxes, and the like.

What is claimed is:

1. A spacer configured to mount a fan housing to a surface of a structural support, the spacer comprising:

a body;

a first aperture passing through the body, the first aperture having a first length through the body;

a second aperture passing through the body, the second aperture having a second length through the body, the second length different than the first length; and a third aperture passing through the body, the third aperture having a third length through the body, the third length different than the first length and the second length;

wherein the body has a first orientation with respect to the fan housing and structural support in which the body separates the fan housing from the surface of the structural support by the first length when installed with a fastener passed through the first aperture and into the structural support;

wherein the body has a second orientation with respect to the fan housing and structural support in which the body separates the fan housing from the surface of the structural support by the second length when installed with a fastener passed through the second aperture and into the structural support; and wherein the body has a third orientation with respect to the fan housing and structural support in which the body separates the fan housing from the surface of the structural support by the third length when installed with a fastener passed through the third aperture and into the structural support.

2. The spacer of claim 1, wherein an end of the first aperture is tapered for guiding a fastener into the first aperture.

3. The spacer of claim 1, wherein the body is constructed of a plastic material, and the first and second apertures are integrated into the body.

4. The spacer of claim 1, wherein the body includes an outwardly extending protrusion for orienting the spacer with respect to the fan housing in at least one of the first, second, and third orientations.

5. The spacer of claim 1, wherein the first aperture and second aperture lie in planes that are substantially perpendicular to one another.

6. The spacer of claim 1, wherein the body includes:

a first mounting surface engageable with the housing when the body is in the first orientation; and a second mounting surface engageable with the housing when the body is in the second orientation, the first mounting surface being substantially perpendicular to the second mounting surface.

7. The spacer of claim 6, further comprising a lip extending outwardly from the body, the lip preventing orientation of the spacer in a fourth orientation in which the first mounting surface is flush with the surface of the structural support.

8. The spacer of claim 7, wherein the lip prevents orientation of the spacer in a fifth orientation in which the second mounting surface is flush with the surface of the structural support.

9. A spacer for mounting a fan housing in positions spaced from a mounting surface of a structural support, the spacer comprising:

a body having a first dimension in a first orientation, a second dimension in a second orientation different than the first orientation, and a third dimension in a third orientation different than the first orientation and the second orientation;

a first aperture defined in the body and shaped to receive a fastener through the body, the first aperture having a length passing through the body that is the same as the first dimension;

a second aperture defined in the body and shaped to receive a fastener through the body; the second aperture having a length passing through the body that is the same as the second dimension;

a third aperture defined in the body and shaped to receive a fastener through the body, the third aperture having a length passing throught the body that is the same as the third dimension;

the spacer having a first mounting orientation with respect to the fan housing and structural support in which the spacer separates the fan housing from the mounting surface of the structural support by a distance substantially the same as the first dimension;

a second mounting orientation with respect to the fan housing and structural support in which the spacer separates the fan housing from the mounting surface of the structural support by a second distance substantially the same as the second dimension, wherein the second distance is different than the first distance; and a third mounting orientation with respect to the fan housing and structural support in which the spacer separates the fan housing from the mounting surface of the structural support by a third distance substantially the same as the third dimension, wherein the third distance is different than the first distance and the second distance.

10. The spacer of claim 9, wherein an end of the first aperture is tapered for guiding a fastener into the first aperture.

11. The spacer of claim 9, wherein the body is constructed of a plastic material, and the first and second apertures are integrated into the body.

12. The spacer of claim 9, wherein the body includes an outwardly extending protrusion for orienting the spacer with respect to the fan housing in at least one of the first and second mounting orientations.

13. The spacer of claim 9, wherein the first aperture and second aperture lie in planes that are substantially perpendicular to one another.

14. The spacer of claim 9, wherein the body includes a first mounting surface engageable with the fan housing when the body is in the first mounting orientation, the spacer further comprising a lip extending outwardly from the body, the lip preventing mounting of the spacer in an orientation in which the first mounting surface is flush with the mounting surface of the structural support.

15. The spacer of claim 14, wherein the body includes a second mounting surface engageable with the fan housing when the body is in the second mounting orientation, the spacer further comprising a second lip extending outwardly from the second mounting surface, the second lip preventing mounting of the spacer in an orientation in which the second mounting surface is flush with the mounting surface of the structural support.

* * * * *